United States Patent [19]

Ralston, Jr. et al.

[11] 4,082,639

[45] Apr. 4, 1978

[54] METHOD AND APPARATUS FOR MERCURY CELL ANODE ADJUSTMENT

[75] Inventors: Richard W. Ralston, Jr.; George K. Ames, both of Cleveland, Tenn.

[73] Assignee: Olin Corporation, New Haven, Conn.

[21] Appl. No.: 725,918

[22] Filed: Sep. 22, 1976

[51] Int. Cl.[2] ..... C25B 15/04; C25B 9/04

[52] U.S. Cl. ..... 204/219; 204/225; 204/228; 204/250

[58] Field of Search ..... 204/99, 219, 220, 250, 204/225, 228

[56] References Cited

U.S. PATENT DOCUMENTS

| | | | |
|---|---|---|---|
| 3,723,285 | 3/1973 | Daga et al. | 204/219 X |
| 3,734,848 | 5/1973 | Bertoni et al. | 204/220 |
| 3,853,723 | 12/1974 | Mack | 204/225 X |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

A method and apparatus for obtaining signals from the anode buses of a mercury cell to provide automatic protection against short circuits, visual readouts, and computer information. A multiplexer is associated with each cell which scans the signals from the various bus bars. The scanned signals from each bus bar are sequential with one another and are converted to proportional voltage and anode bus current signals, which are transmitted to a console for decoding and processing to provide a visual readout and to a computer for processing and anode adjustment. In addition, each cell has an overcurrent and short circuit protection circuit based upon anode bus current. The instantaneous anode bus current for a given bus of a cell is compared with an average anode bus current for that cell and the anodes raised when the current exceeds the average bus current by a certain percentage.

24 Claims, 4 Drawing Figures

METHOD AND APPARATUS FOR MERCURY CELL ANODE ADJUSTMENT

BACKGROUND OF THE INVENTION

The present invention relates to a method and apparatus for adjusting anodes in an electrolytic cell. More particularly this invention relates to a method and apparatus for generating voltage and current signals for use in adjusting the anode-cathode spacing in mercury cells and also for automatically raising the anode with respect to the cathode to prevent overcurrent and short circuits.

Electrolytic mercury cells have been used commercially in the production of chlorine and caustic by the electrolysis of brine for many years. In general these cells employ a metal cell container which slopes slightly downwardly from one end to the other, and which utilizes a cathode comprised of a moving stream of mercury on the bottom of the cell. A stream of brine flows on the top of the mercury cathode in the cell container. Anodes, fabricated either from graphite or metal, are secured to the top of the cell container and positioned in the brine above the mercury cathode.

When a voltage is applied across the cell, current flows from the anode through the brine electrolyte to the cathode and causes electrolysis of the brine and the formation of gaseous chloride, which is removed from the cell, purified and stored. Elemental sodium, another product of the electrolysis forms an amalgam with the mercury cathode and is removed from the cell and processed to form a caustic solution. Regenerated mercury from the amalgam is recycled for use as a cell cathode.

A plurality of electrolytic mercury cells are normally electrically connected in an electrical series circuit. Each cell usually has a plurality of anode buses which are electrically connected to the cathode side of an adjacent cell. In some instances the anodes of each cell may be divided into sets with each set of anodes of a given cell being separately adjustable to raise and lower the anodes of a given set with respect to the mercury cathode. Each anode set may be provided with one or a plurality of anode buses. With cells of this design, a motor is associated with each anode set to raise and lower the anodes of the set.

According to another cell design, all the anodes of the cell are raised and lowered simultaneously. In this case, a motor is associated with the entire group of anodes to raise and lower the anodes.

Whatever the design of the cell, the control of the inter-electrode distance between the anode and cathode is economically important. The inter-electrode distance should be as small as possible to reduce the wasteful consumption of energy.

In addition to the problem of maintaining the optimum anode-cathode spacing in mercury cells, the problem of preventing short circuiting due to contact between the mercury cathode and anode is also of importance. Such short circuits may be caused by breakage of a graphite anode, by loosening of anode support posts, by changes in the thickness of mercury due to faulty flow control, or other causes which allow the anode to contact the flowing mercury cathode. The resulting short circuit causes an excessive flow of current in the anode and in the anode bus serving that anode, along with anode damage, overheating of the anode leads, loss in production of chlorine, excessive hydrogen in the chlorine, and other problems. In addition, with metallic anodes, a short circuit damages the active coating and the support structure which cannot be economically tolerated.

Numerous techniques have been developed for adjusting the anode-cathode gap in electrolytic cells. See, for example, U.S. Pat. Nos. 3,574,073, which issued Aug. 6, 1971; 3,873,430, which issued Oct. 25, 1975; and 3,900,373, which issued Aug. 19, 1975. In general these patents describe a method of adjusting the anodes by transmitting current and voltage signals to a computer or to some type of visual readout or both. The operator, during manual control of the anode sets, can raise or lower a particular anode set through a motor control system until the desired operating condition is reached. Alternatively, these systems may utilize a digital computer which can perform various operations and actuate the motor control circuit to raise or lower the anode sets until the desired condition is reached.

In addition, such patents as the aforementioned U.S. Pat. No. 3,574,073, as well as U.S. Pat. No. 3,844,913, issued Oct. 29, 1974, disclose systems for the automatic raising of the anodes or anode sets of a given cell upon the sensing of an overcurrent or short circuit condition.

SUMMARY OF THE INVENTION

The present invention relates to an improved system for obtaining voltage and current signals from an electrolytic cell and transmitting such signals to such items as a console for visual display, to a computer interface for permitting the computer to provide readouts of various parameters and automatically control the anode-cathode spacing, and to an overcurrent motor control circuit which will raise the anodes upon detection of an incipient short circuit.

According to the present invention a multiplexer or scanner is associated with each cell. The multiplexer continuously and rapidly scans all bus bars of the cell with which it is associated and transmits current and voltage signals associated with each bus bar to a console and computer as well as to an overcurrent motor control circuit.

In the overcurrent motor control circuit, the individual bus bar current signals in sequence from the multiplexer are compared with a signal representing the average bus bar current. In the event that the individual bus bar current signal exceeds the average bus bar current signal of the given cell by a predetermined amount, the raise mode of the motor control circuit is actuated causing the motor to raise the anode for a predetermined time period upon the receipt of each signal pulse. The motor will continue to operate until the individual bus bar current signal drops to a value equal to or less than the average bus bar current signal.

The use of a scanner or multiplexer with each cell enables the current and voltage signals to be transmitted to the console in a manner which easily permits the various readings to be visually displayed on an oscilloscope with the readings for each of the anode buses of the given cell being visible at the same time.

In addition, the voltage drop across the cell bottom bus joint connection for each anode bus can be scanned using the multiplexer associated with each cell to provide a readout of the voltage drop associated therewith.

DETAILED DESCRIPTION

Figure 1:
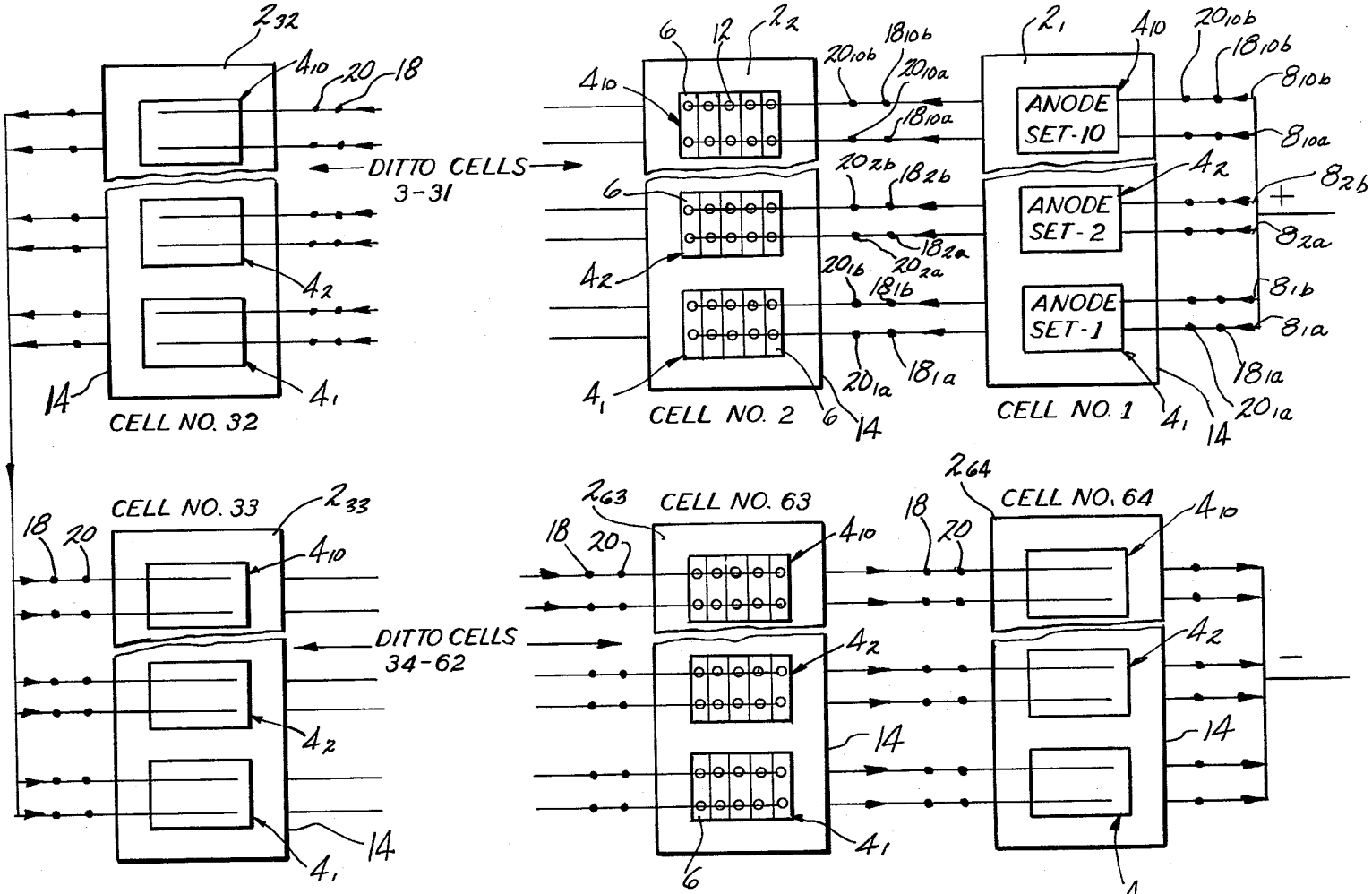
FIG. 1 is a schematic drawing of a plurality of cells in a cell room showing how they are electrically interconnected.

The present invention is particularly applicable for use in connection with a plurality of electrically interconnected mercury cells as typically found in a cell room. FIG. 1, discloses a typical arrangement wherein 64 mercury cells 2 are electrically connected in series with two rows of cells, 32 cells in a row. Each cell 2 is designated in the cell room by a different number for reference purposes as indicated on the drawing with the subscript to reference numeral 2 indicating the particular cell number.

Each cell 2 may be provided with one or a plurality of anode sets 4, each set containing one or a plurality of anodes 6. As shown in FIG. 1, one arrangement is 10 anode sets 4 with five anodes per anode set. The anode sets 4 of a given cell 2 are electrically connected in parallel to the cathode of a preceeding cell by anode buses 8. Each anode set 4 may have one or a plurality of anode buses 8. As shown, each anode set 4 of FIG. 1 has two anode buses $\mathbf{8}_a$ and $\mathbf{8}_b$ with the subscript number indicating the particular anode set 4 with which a particular anode bus 8 is associated. Thus $\mathbf{8}_{10b}$ for example refers to the second or "*b*" anode bus 8 associated with the tenth anode set 4.

Figure 4:
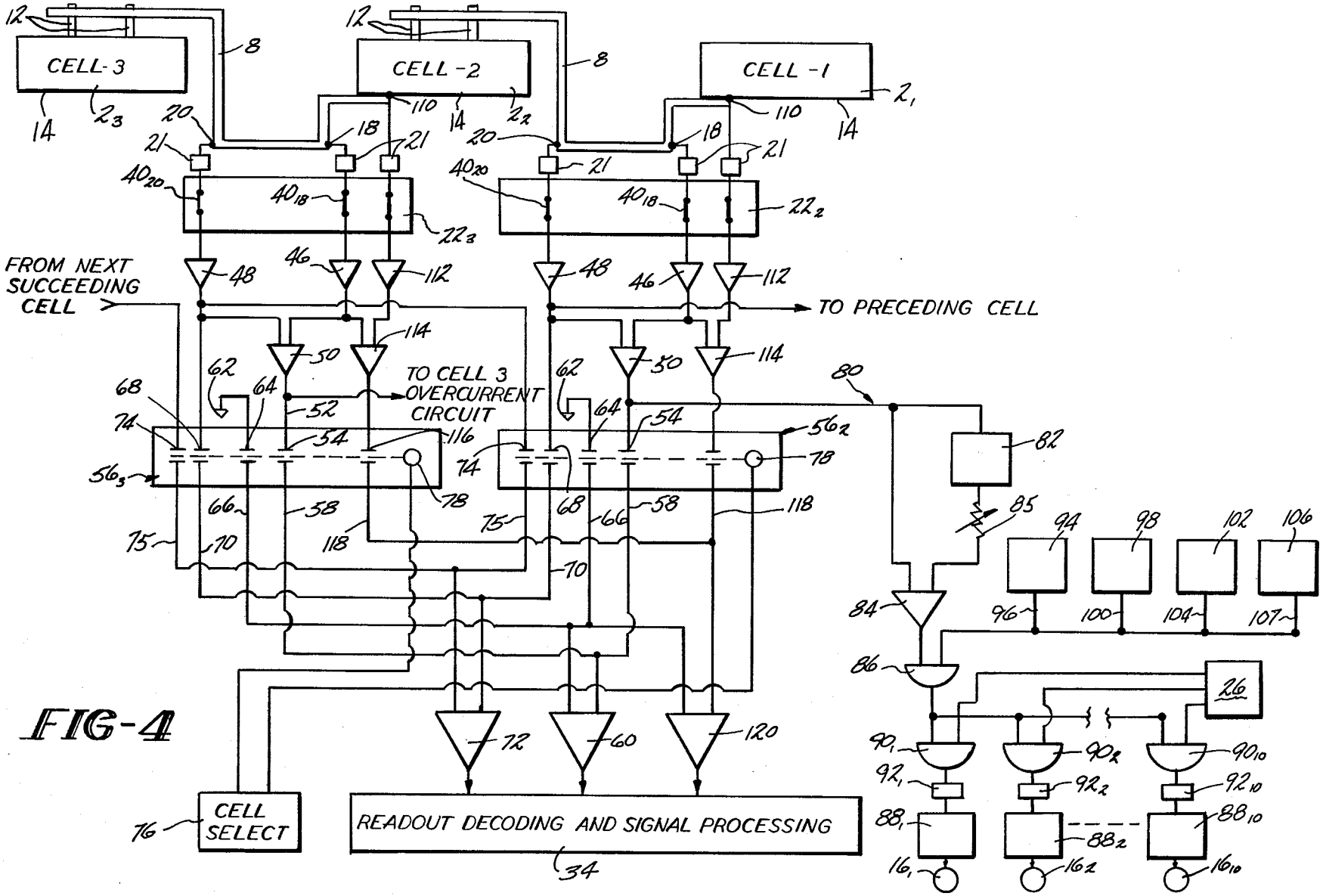
FIG. 4 is a more detailed diagram of the electrical circuit of the present invention as applied to a single anode bus.

Each anode 6 is provided with at least one anode post 12, and, according to FIGS. 1 and 4, preferably with two anode posts 12 arranged in two parallel rows. One of the anode buses 8 is connected to each row of anode posts in a given cell 2. The other end of the anode bus 8 is connected to a terminal at the metallic bottom 14 of the cell 2 at a point nearest its associated anode 6. Current from plant supply (not shown) is conveyed to each of the anode buses 8 of cell $\mathbf{2}_1$ and then to anode posts 12 associated with the particular anode bus 8. Current from the anode posts 12 of cell $\mathbf{2}_1$ passes to the anodes 6 of that cell $\mathbf{2}_1$, through the electrolyte (not shown), the mercury amalgam (not shown) to the bottom 14 of cell $\mathbf{2}_1$.

Each of the anode buses of cell $\mathbf{2}_2$ carry current from the bottom of cell $\mathbf{2}_1$, to their associated anode posts 12, through the anode posts 12, the anodes 6, electrolyte, and mercury amalgam to the bottom of cell $\mathbf{2}_2$. In a similar matter current is carried to all of the cells 2 in the cell room that are electrically connected together.

Each of the anode sets 4 have a motor 16 (see FIG. 4) associated therewith which when operated causes all of the anodes 6 of that anode set 4 to be raised or be lowered with respect to the cathode. Thus in the embodiment shown in FIG. 1, there would be 640 motors, one motor being associated with each of the ten anode sets each of the 64 cells.

As an alternative, in some arrangements, there may not be distinct movable anode sets within a cell, but rather all the anodes of a cell may be raised or lowered simultaneously by the use of a single motor. The present invention is applicable to both arrangements.

Each anode bus 8 of each cell is tapped as indicated in FIG. 1. This is accomplished by providing spaced terminals or taps 18 and 20 along each anode bus 8. The subscripts used in connection with the spaced terminals 18 and 20 indicate the particular bus that is being tapped. For example, terminal $\mathbf{18}_{1a}$ indicates terminal 18 associated with the first anode bus $\mathbf{8}_{1a}$ of the first anode set $\mathbf{4}_1$. The terminals 18 and 20 of each anode bus are used to generate a direct current millivolt signal proportional to current flow. A volt signal proportional to voltage drop across an anode set 4 associated with a given anode bus for a given cell is generated by using terminal 20 of the next cell. For example, the signal for the voltage drop for Cell No. 1, reference number $\mathbf{2}_1$, in FIG. 1, associated with anode bus $\mathbf{8}_{1a}$ and the anode set $\mathbf{4}_1$, is generated by using signals from terminal $\mathbf{20}_{1a}$ of the bus $\mathbf{8}_{1a}$ of cell $\mathbf{2}_1$ and terminal $\mathbf{20}_{1a}$ of bus $\mathbf{8}_{1a}$ of cell $\mathbf{2}_2$.

As seen in FIG. 4, the input signals from terminals 18 and 20 may be temperature compensated by an appropriate electrical circuit such as a thermistor circuit as shown and described in U.S. Pat. No. 3,900,373, issued Aug. 19, 1975, to R. W. Ralston, Jr. and which is incorporated herein in its entirety. The input signals from terminals 18 and 20 may also be filtered by filter 21.

Figure 2:
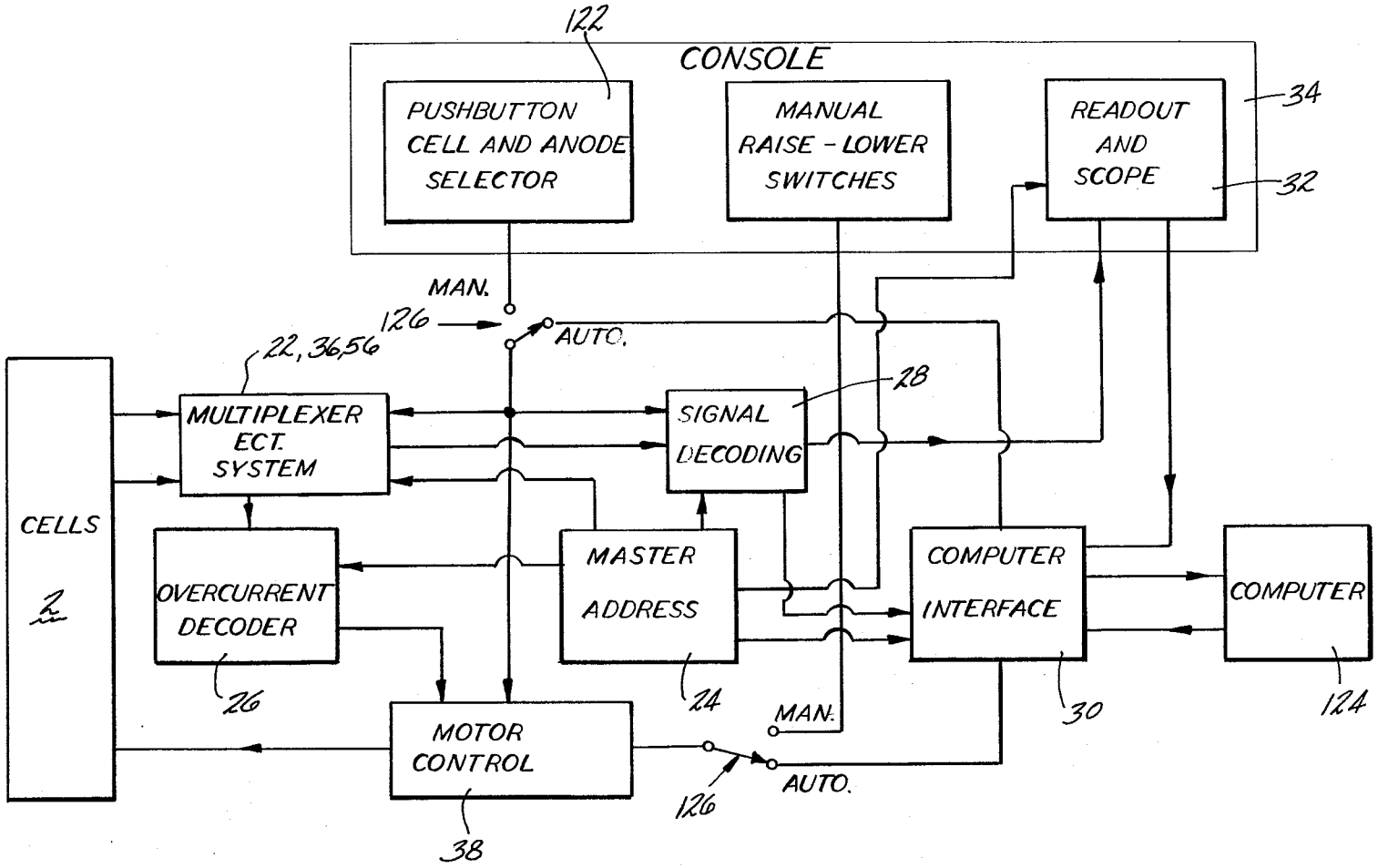
FIG. 2 is a block diagram showing generally the layout of the apparatus of the present invention.

The system in the present invention as shown in FIG. 2 includes the use of a multiplexer 22 in association with each cell 2 which receives signals from all the terminals 18 and 20 of all the bus bars 8 of its associated cell simultaneously. The output from the multiplexer at any given time is two signals, one from each of the terminals 18 and 20 on one particular bus 8. The multiplexer continuously scans the bus bar signals so that one of its outputs is all the signals from the terminals 18 of all buses 8 of its associated cell in sequence, and another output is all the signals from the terminals 20 of all the bus bars 8 of its associated cell in sequence.

As shown in FIG. 2, all the multiplexers 22 are driven by a master address system 24 that is synchronized with the power frequency. The master address system also drives the overcurrent decoder 26, the signal decoding system 28, the computer interface 30, and supplies the synchronizing pulse for an oscilloscope which is part of the readout and oscilloscope section 32 of a console 34. The signals from each multiplexer 22 pass through an associated amplifier system 36 (See FIG. 3) where the multplexer signals are buffered and a differential amplifier is used to obtain a signal proportional to the bus kiloamperes. The current signal is supplied to a motor control circuit 38 where it is compared to the average bus current of the cell and will cause the raise mode of motor operation to actuate if any instantaneous current signal from a given bus 8 exceeds the average bus current of the cell by a predetermined amount. In the case where there is more than one motor per cell, the current signals associated with the buses of a given cell are supplied to the motor overcurrent decoder 26, which in conjunction with the signals from the master address system 24, electronically selects which of the motors should be operated to raise the anodes associated therewith. With this arrangement, only the anodes associated with the bus which indicated the overcurrent signal will be raised.

The signal decoder 28, in addition to performing various calculations electronically such as averaging cell voltage and current, also samples and holds the respective signals until called for by either the manual anode selector or by the computer.

Figure 3:
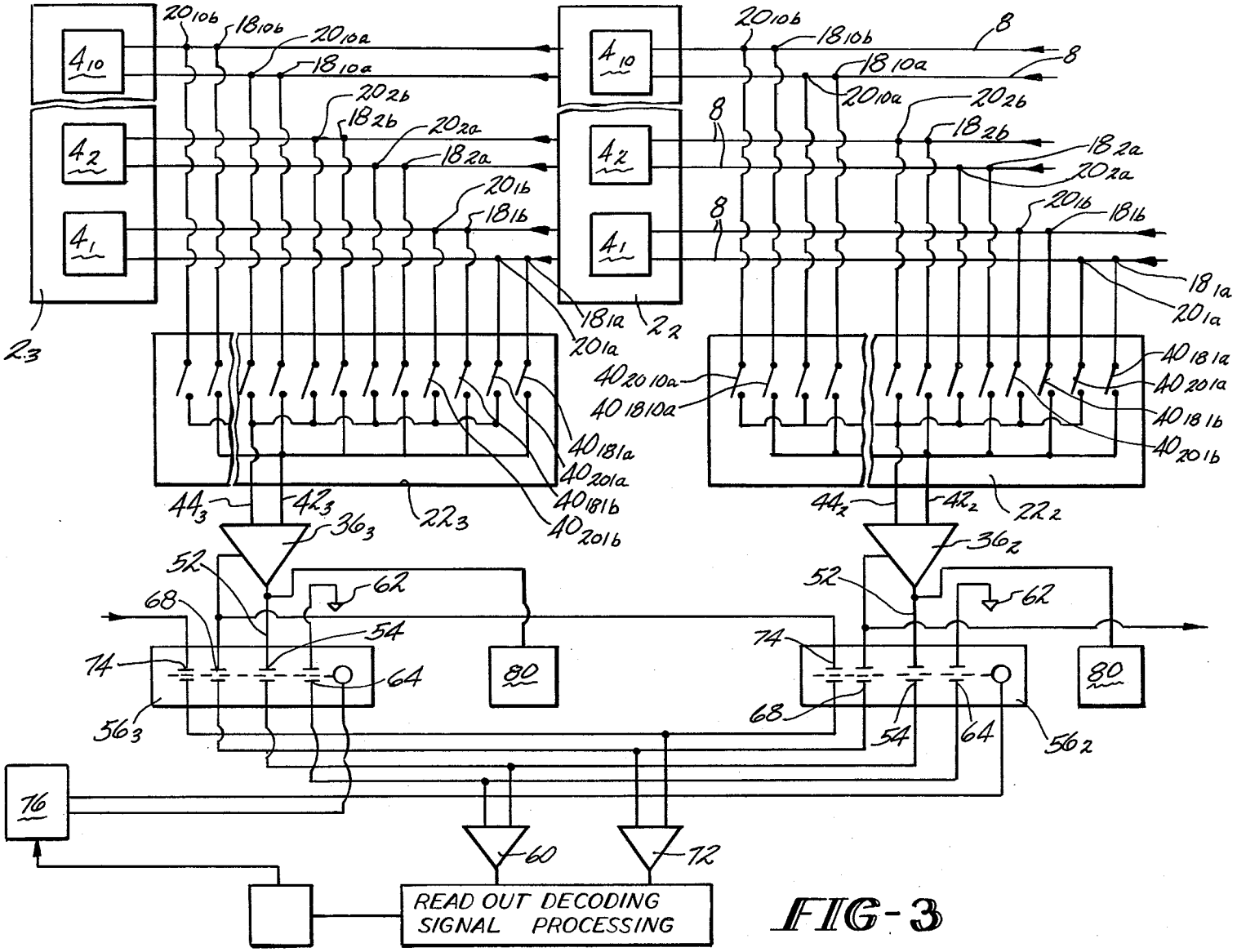
FIG. 3 is a schematic diagram of the electrical circuit of the present invention.

FIG. 3 shows in more detail the electronic detail of the system of the present invention as applied to two adjacent cells, for example, cells $2_2$ and $2_3$ (Cell No. 2 and Cell No. 3 of FIG. 1). The signals from each tap 18 and 20 of each bus 8 for a given cell 2 are fed into the multiplexer 22 associated with that particular cell 2. The multiplexer 22 may be considered a plurality of individual switches 40, one switch associated with each of the taps 18 and 20 of each bus 8. The multiplexer 22 is solid state to permit a "fast" scanning rate. In the embodiment shown in FIG. 3, the multiplexer 22 has two output channels 42 and 44, output channel 42 for the signals from the taps 18 and output 44 for signals from the taps 20.

The multiplexer, driven by the master address system 24, closes simultaneously the switch $40_{181a}$ associated with the tap 18, on the first bus of the first anode set and switch $40_{201a}$ associated with tap 20 on the first bus of the first anode set, permitting such signals to pass through their respective multiplexer outputs 42 and 44 to the amplifier system 36. The same switches $40_{181a}$ and $40_{201a}$ on all the multiplexers of all the cells are closed at the same time by the master address system 24 (FIG. 2).

The master address system 24 serves to scan all of the bus signals by opening the contacts 40 associated with terminals 18 and 20 on the first bus 8 of the first anode set and closing the switches $40_{181b}$ and $40_{201b}$ associated with the second bus of the first anode set permitting those signals to pass through outputs 42 and 44 simultaneously to the amplifier system 36. This process continues until the signals from each bus 8 have been scanned sequentially, whereupon the scanning process starts over again. The rate of scanning, related to the power frequency, is at "fast" speed, which herein means a speed such that all channels of the multiplexer are scanned in 1/60 of a second. Other fast speed scan rates which are multiples of the power frequency may be used. For example, if the power frequency is 60 Hz, the rate of scanning of all channels could also be 1/30, 1/120 or 1/360.

Thus, for the system shown, the multiplexer 22 will address sequentially 20 sets of two inputs. If desired, another switch, or channel may be provided on the multiplexer which may be used for zero reference and calibration, and which would be scanned sequentially after the last bus tap signals.

The amplifier system 36 is shown in more detail in FIG. 4 which shows the electronic circuit in simplified form as applied to one bus 8 of Cell No. 2 and the equivalent bus 8 of Cell No. 3. The signals from taps 18 and 20 pass through their associated switches 40 in the multiplexer 22 and are buffered by individual unity gain, differential amplifiers 46 and 48. The outputs from the amplifiers 46 and 48 are simultaneously amplified and converted by differntial amplifier 50 to a single-ended voltage signal, referenced to cell common, and proportional to the bus kiloamperes (bus current). The output 52 of the differential amplifier 50 is transmitted to a contact 54 of a cell select relay 56. As will be noted, each cell 2 has an associated cell select relay 56. The relay output 58 of the current signal from at least a plurality of cell select relays 56 are connected to a single isolation amplifier 60. The cell common 62 for each cell, to which the single-ended voltage proportional to current is referenced is also transmitted through a contact 64 of the cell relay 56 of its associated cell and the output 66 fed to isolation amplifier 60. The isolation amplifier 60 converts the high common-mode voltages to single-ended signals referenced to the console common, which is preferably earth potential. The cell common for each cell is preferably referenced back by a separate line to tap 18 of the middle bus of a given cell, for example, tap 18 of either bus $8_{5b}$ or $8_{5a}$ of the arrangement shown in FIG. 1.

The output from amplifier 48, i.e., the buffered signal from tap 20 of the bus bar 8, is also fed to a contact 68 of its associated cell relay 56, the output 70 of which is fed to an isolation amplifier 72. The output signal from the amplifier 48 associated with the next successive cell is also fed to a contact 74 of the cell select relay 56 associated with a given cell with the output 75 fed to the isolation amplifier 72. Isolation amplifier 72 converts the signals to a single-ended voltage, reference to the console common, and proportional to the voltage drop associated with a given anode set and one of its associated buses. Depending upon the particular configuration of a given bus, the signals from amplifier 46 may be used for obtaining the anode set voltage signals.

A cell select circuit 76, which may either be manually or computer operated, causes the actuation of the cell relay coil 78 to close the contacts 54, 64, 68, and 74 of a given relay when the cell with which that relay is associated is selected. Upon the closure of the contacts of any cell select relay 56, the voltage and current signals for all the buses 8 of that cell are passed to the console for decoding, readout, and signal processing.

If there are a relatively large number of cells that are connected in series, it may be desirable to sectionalize the signals from the cells by sectionalizing relays (tree relays). For example, with the arrangement shown in FIG. 1 which depicts a total of 64 cells, there may be eight sectionalizing relays, one for cells 1–8, another for cells 9–16, etc. All signals from each individual cell select relay associated with cells 1 to 8 would pass through a single sectionalizing relay before passing to the isolation amplifiers. In addition, there may be more than one set of isolation amplifiers 60 and 72. In the specific embodiment mentioned above wherein there are 64 cells, those may be two sets of isolation amplifiers 60 and 72, one set for the signals from cells 1 to 32 and the second set for the signals from cells 33 to 64. All the isolation amplifiers 60 and 72 may be separated from the readout, decoding and signal processing 34 by a suitable relay. With such an arrangement, when a given cell is selected, the individual cell select relay 56 must be actuated, the sectionalizing relay with which that cell is associated must be activated, as well as the relays associated with the set of amplifiers associated with that particular sectionalizing relay.

The current signals, i.e., the output from differential amplifier 50, from all the buses are also fed to an overcurrent circuit 80 for automatic prevention of overcurrent and short circuits. Each cell has its own individual overcurrent circuit 80. The overcurrent circuit 80 includes an averaging circuit 82 which continuously averages the instantaneous individual bus current signals for the cell to obtain an average cell anode bus current. This average bus current signal is then transmitted to a comparator 84. The instantaneous current signals from amplifier 50 are transmitted to the comparator 84 which serves to compare the instantaneous current signal of the buses 8 sequentially with the average bus current. If the instantaneous current signal of any given bus bar is determined to be higher than the average bus current by a predetermined percentage, the comparator 84 will send a signal to the overcurrent interlock 86.

An adjustment circuit 85 is associated with the comparator 84 so that the percentage by which the instantaneous current signal must exceed the average anode bus signal before a signal is sent to the interlock 86 may be varied. The range of adjustment may be such that the comparator 84 will send a signal to the interlock when the instantaneous current is between 100 to 200 percent of the average current. The preferred range is between 100 and 150 percent with 130 percent being the desired set point in many cases. It is to be noted that the average anode bus current is proportional to total cell current or system load current. Therefore, the set point for comparison with the instantaneous anode bus current automatically changes as the total cell current changes.

In the event there is more than one motor associated with a given cell such that one anode set can be raised independently of the others, each motor will have its own motor control circuit 88. A logic system is provided to determine which one of the motor control circuits should be raised depending upon which anode bus has indicated a high current. The signals from the interlock 86 are a series of pulses that are time related to the individual bus inputs. These pulses are simultaneously sent to a series of logic elements 90, one associated with each motor control circuit 88. The motor overcurrent decoder 26, run by the master address system 24, decodes the signal information and supplies a signal to the appropriate logic element 90. When an individual logic element 90 receives a signal from both the interlock 86 and decoder 26, a signal is transmitted to the motor control 88 to actuate the raise mode of the motor control and operate the motor 16.

Due to the fact that each signal pulse transmitted to the motor control circuit is of a very small time duration, it is desirable that the motor control include a timing circuit 92. This timing circuit determines the length of time that the raise mode of the motor control circuit will be actuated upon receiving a single pulse from the logic element 90. The timing circuit may be adjustable up to several seconds. If, after the time interval, the motor control circuit continues to receive signals from the logic element 70, the motor will continue to operate. The motor will constantly raise the particular anode set until the current signal from the particular anode bus decreases until it reaches the set point of the comparator 82.

In the event that only one motor is associated with a given cell, and all the anodes of the cell are raised simultaneously, the logic elements 90 and motor overcurrent decoder 26 are not needed, and only one motor control circuit 88 is necessary. In such a case, the signal from interlock 86 would pass directly to the motor control circuit 88 including a timing circuit 92, and function as explained above.

In some instances it is desirable to disable the overcurrent motor raise circuit 80. One such instance is where, because of load changes, the load in the cell becomes so low that a relatively small change in current in one of the anode buses would result in actuation of the raise mode of the motor control. For this purpose, a low load current interlock circuit 94 may be provided. This circuit 94 compares the average anode bus current with a set point, and if the average anode bus current is below the set point, an output signal 96 will be sent to the interlock 86 preventing the signal from the comparator 86 from being transmitted to any of the motor control systems 88. The set point should be adjustable, and may be a percentage of the rated current flow through an individual anode bus. For example, the set point should be adjustable between a range of 0 to 30 percent of the total rated anode current. For example, if 137 kiloamperes is normally applied to each cell unit through 20 parallel buses, then each anode bus would carry 6.8 kiloamperes. The set point should then be between 0 and 2.14 kiloamperes. Normally, it is desirable to have the set point at 10 percent, which in the example just given would be 0.68 kiloamperes. The set point adjustment may be accomplished by using a single turn potentiometer. The average anode current signal may be derived from the output of the averager 82.

It is also desirable to disable the overcurrent motor raise circuit 80 when the cell switch is closed, i.e., when the cell is short circuited by the cell shorting switch. This may be accomplished in one of three ways depending upon whether the cell construction is such that a pair of cells are shorted by a single shorting switch, or as each cell has its own shorting switch.

In the case where a pair of cells is shorted by a single shorting switch, the arrangement is usually such that the switch is physically associated with one cell and causes the current to pass from the anode buses of the preceeding cell to the anode buses leading to the next succeeding cell. The switch is normally associated with an even numbered cell. Thus, referring to FIGS. 1 and 4, with the switch associated with cell number 2, then the closing of the switch will complete a circuit from the anode buses 8 of Cell No. 1 to the cell bottom 14 of Cell No. 2, completely bypassing the anode buses 8 of Cell No. 2. In this instance, the low load current interlock system described above can be utilized for disabling when the cell shorting switch is closed. However, appropriate circuitry must be added so that sensing of low current by the buses of the cell with which the switch is associated will not only disable that cell's overload motor raise circuit 80, but will also disable the overload motor raise circuit of the preceeding cell by sending a signal to its interlock 86.

In the case where each cell has its own shorting switch, it is necessary to provide a different arrangement for preventing operation of the motor control circuit 80. This is due the fact that with such an arrangement, the taps 18 and 20 will be located in a portion of the bus where current passes through the bus even though that cell is short circuited. In this case, a low voltage interlock circuit 98 may be provided. When the cell switch is closed the cell voltage is very low, equal to the bus and switch voltage drop and usually below 1.0 volts. To disable the overload motor raise circuit in such a case, a signal is obtained from the common on that particular cell and the common on the next cell and filtered and time delayed. This signal is compared to an adjustable bias which is adjusted to a fixed set point, and which, if the voltage signal falls below it, will send a signal 100 to the interlock 86 which will prevent the signal from the comparator 84 from being transmitted to any of the motor controls 88. The set point adjustment may include a single turn potentiometer which has an adjustment range of 0 to 5 volts.

In the case where each cell has its own shorting switch a third arrangement can be used for preventing operation of the motor control circuit 80. The cell switch position may be mechanically or electrically sensed and an electrical signal generated when the switch is closed and sent to the interlock 86 to prevent the signal from the comparator from being sent to any of the motor controls 88.

A third condition under which the overload motor circuit should be disabled is when the anode-cathode gap becomes too large. This could result from a failure in the system such that the motor controls raise an anode set or all anodes past the point as which the signals from the comparator 84 should cease. As an excessive anode-cathode gap results in high voltage, a high voltage interlock circuit 102 may be provided to disable the overcurrent motor raise circuit 80. In this case, a voltage signal, obtained as mentioned above in connection with the low voltage interlock circuit, is compared to an adjustable bias, which is adjusted to a fixed set point. If the voltage signal exceeds the set point, a signal 104 is sent to the interlock and prevents the signal from the comparator from being transmitted to any of the motor control systems 88. The set point adjustment may include a single turn potentiometer and be adjustable between 4.5 and 6.5 volts.

The fourth condition for which it is desirable to disable the overcurrent motor raise circuit 80 is when no load tap changes or switching is being made at the rectifier which usually results in considerable disturbance on the cell electrical system. Such disturbances could cause an impulse signal which would result in the activation of the overcurrent motor control when not necessary. To disable the motor control circuit under this condition, the equipment used for rectifier switching and no-load tap changing may provide interlock contacts to circuit 106. The closure of any of the interlock contacts serves to send a signal 107 to all the interlocks 86 for each cell which will prevent the signal from the comparator 84 from being transmitted to the motor control circuits 88. This signal, which is transmitted to all of the cell overcurrent interlocks 86, is adjustable to remain on for a set period of time. This time adjustment may vary from about 0 to about 5 seconds. Preferably the time delay for the signal to turn off is 3 seconds.

Another feature of the present invention is the determination of the millivolt drop across the cell bottom bus joint connection. Each anode bus 8 is connected to the cell bottom of the preceeding cell by a suitable connection. This connection has its own voltage drop and requires a certain amount of power. As time passes, these joints become worn and consume a greater and greater amount of power. At some point, due to the high cost of power, it becomes economical to clean or replace the connections. The present invention makes use of the multiplexer 22 of each cell 2 to scan a signal which may be used to provide a readout of the millivolt drop across the bus joint connection.

The bus joint signal feature is shown in FIG. 4 which shows a tap 110 connected to the cell bottom 14 adjacent the end of the bus 8 which connects with the anodes of the next succeeding cell. Each bus 8 of every cell 2 has a tap 110 associated with it. The signals from each of the taps 110 are filtered and connected to the multiplexer 22 with a single output from the multiplexer being transmitted to a differential amplifier 112 where the signal is buffered. The output from the amplifier 112 is transmitted to a differential amplifier 114. The output from the amplifier 46 associated with tap 18 is also transmitted to the differential amplifier 114. The differential amplifier 114 converts the signals to a single-ended voltage signal, reference to cell common, and proportional to the millivolt drop across the cell bottom bus joint. The output from the differential amplifier 114 is transmitted to a contact 116 of the cell select relay 56. The corresponding output 118 from all, or at least a plurality of relays 56 are transmitted to a single isolation amplifier 120. The output 66 from the contact 64 of the cell relay 56 conveying cell common is also transmitted to the isolation amplifier 120. The isolation amplifier converts the differential signals at high common-mode voltage to a single-ended signal, referenced to the console common and proportional to the voltage drop of the bus joint connection. If sectionalizing relays and a plurality of isolation amplifiers 120 are used as explained above, the output from differential amplifier 112 associated with a given cell would pass through its individual cell select relay 56, the sectionalizing relay associated with that particular cell, and the isolation amplifier 112 associated with that particular sectionalizing relay.

As an alternative, for the purpose of obtaining the bus joint voltage, the signal from tap 18 may pass through a separate filter circuit, a separate channel on the multiplexer, a separate buffer amplifier, and be connected to differential amplifier 114. This is in place of using the signal from amplifier 46 as one of the inputs to the differential amplifier 114 and permits heavy filtering to improve the bus joint voltage readout without affecting the current signals.

As explained above in connection with the voltage and current signals, each multiplexer scans all of the signals on each bus bar, one bus bar at a time, so that the various bus bar signals are fed sequentially through the multiplexer to the amplifier system. Thus, the signal from tap 110 on a given bus bar will be fed through the multiplexer at the same time the signal from tap 18 of that bus is being fed. Thus when cell select 76 actuates a given relay 56, the bus joint voltage signals from each anode will be fed sequentially through the isolation amplifier 120 into the console.

Within the console, or signal decoding system 28, the bus joint signals are decoded and processed by conventional electrical circuitry so that a readout of the bus joint voltage drop of any given anode bus can be displayed or transmitted to the computer if desired. The display may be either analog or digital as desired.

The master address system 24 may include a multivibrator clock synchronized to the line frequency. As the line frequency is usually 60 Hz, the clock cycle should be such that it runs a binary address signal generator at a rate which will address all the inputs of the multiplexer and then repeat at the rate of 60 per second. Other scan rates may be used such as 30, 120, or 360 repeats per minute. An address checking circuit may also be included for testing for failure in the address. Upon detection of address failure, an indicator light and/or an external audible alarm may be actuated. The master address system also drives the signal decoding system 28 and the motor overcurrent decoder 26.

Referring to FIG. 2, the cell and anode select may be operated by a keyboard or pushbuttons on the console during manual operation or by the computer 124 for automatic operation. Switches 126 are provided to change from one mode of operation to the other. Once a particular cell and anode are selected, the appropriate cell select relay is actuated and the signal decoder 28 operates the sample and hold circuits to select the proper readout signals for display.

The multiplexer, which transmits the signals from the various anode buses of a given cell in sequence, permits all the bus current signals and all the anode set voltage signals to be displayed as separate traces on an oscilloscope. In addition, the bus current signal trace can be displayed on the oscilloscope along with a trace representing the average current. Also, an electrical circuit can be utilized to calculate the anode set coefficient and average cell coefficient and display the signal on the oscilloscope. The anode set voltage signals for a given cell may also be displayed as a signal trace on the oscilloscope along with a trace of cell voltage. The average bus current, cell voltage, and cell coefficient traces may contain an anode bus select (marker) pulse to indicate on the oscilloscope which bus is being monitored by the digital meter when operating in the manual mode.

The computer, receiving signals through the computer interface 30 can be used to provide for automatic adjustment of the anode-cathode gap. One such method is the use of the voltage coefficient to obtain the optimum spacing. The voltage coefficient $Vc$ is calculated according to the formula:

$$Vc = (V-D)/(KA/M^2)$$

where V is the measured voltage for the electrolytic unit such as the anode set; D is the decomposition voltage for the electrolysis being conducted and $KA/M^2$ is the current density in kiloamperes per square meter of cathode surface below the anode set. In the electrolysis of sodium chloride in a mercury cell for producing chlorine the value for V is about 3.1. Thus, utilizing the voltage and current signals obtained from the multiplexer, the computer can calculate the voltage coefficient for any given anode set. The use of the computer for anode adjustment is described more fully in U.S. Pat. Nos. 3,873,430 and 3,900,373 which are incorporated herein by reference in their entirety.

When the system is on manual control by switches 126, often a given cell and anode bus is selected, the manual raise and lower switches 128 may be used by an operator to actuate the appropriate motor control circuit.

By virtue of the above described arrangement, a relatively simple system is utilized for obtaining voltage and current signals from each of the anode buses of a given cell. These signals may be used to operate an overcurrent motor raise circuit, may be visually displayed on an oscilloscope or analog, or digital meter and provide signals for a computer to automatically adjust the anode-cathode spacing.

What is claimed is:

1. In a mercury cell circuit having a plurality of liquid cathode electrolytic cells in series, each of said cells having at least one anode, at least one motor means associated with each cell for raising at least one anode of said associated cell and a plurality of anode buses, the improvement comprising:

a. signal generator means for generating signals from two spaced apart paired taps on each anode bus of each cell, b. first and second solid state multiplexer means associated with a first and second one of said cells, respectively, and independently simultaneously operable for fast scanning the signals from each anode bus of said first and second cell, respectively, and continuously and simultaneously transmitting a pair of signals from each of said cells, said pair of signals including sequential portions of the paired signals from each anode bus of that cell in sequence, c. converter means for simultaneously converting each pair of said transmitted multiplexed signals into a single analog signal proportional to the anode bus currents of the cell from which said converted multiplexed signals originated, d. overcurrent circuit means for simultaneously modifying said converted multiplexed single signal of each of said multiplexers to produce an overcurrent signal when an overcurrent exists in an anode bus of at least one of said cells, and e. transmitter means for simultaneously transmitting said overcurrent signal of each multiplexer to the motor means associated with the anode bus from which the converted multiplexed single signal was generated so as to be able to simultaneously adjust anodes of a plurality of said cells.

2. The cell circuit of claim 1 wherein said means for converting said scanned signals include a differential amplifier.

3. The cell circuit of claim 1 further including means for combining signals from all the same taps of the anode buses of the next succeeding cell after said signals have been transmitted from the multiplexer means with the signals from the same tap on all the buses after they have been transmitted to provide a voltage proportional signal associated with each anode bus of the given cell in sequence.

4. The cell circuit of claim 1 wherein there are a plurality of anode sets movable with respect to each other and the cathode, each anode set having at least one anode bus associated therewith.

5. An apparatus for adjusting the anode-cathode gap of electrolytic cells of the liquid cathode type which are electrically connected in series, each cell including at least one anode, a plurality of anode buses connecting a given cell with the negative side of the preceding cell, and motor means operated by motor control means for causing the anode to raise and lower with respect to said cathode, said apparatus including:

a. two spaced apart paired taps on each anode bus of each cell;

b. means for generating a signal from each tap;

c. multiplexer means associated with each cell for fast scanning the paired signals from each anode bus of said associated cell and having an output for each of the taps to produce a pair of signals having portions of the signals from the paired taps of any one anode bus being in sequence with portions of the paired signals from the other buses;

d. means associated with each cell for converting said pair of multiplexed signals from said multiplexer means to a signal proportional to current flow in each of the anode buses of the cell;

e. means for converting said current proportional signal to an average cell bus current signal; and f. comparator means for simultaneously and continuously comparing an instantaneous current proportional signal from each of said cells with said average cell bus current signal for that cell and sending a signal to a motor control system for that cell when said instantaneous signal exceeds said average cell bus current signal by a predetermined percentage to cause the motor means to raise the anode to which the bus from which said excessive instantaneous signal originated.

6. The apparatus of claim 5 further comprising timing means for causing the motor to continue to raise the anode for a predetermined minimum period of time after one signal pulse has been received by the motor control from the comparator means.

7. The apparatus of claim 5 further including means for preventing said comparator means from sending a signal to said motor control means when said average current signal is below a preset value.

8. The apparatus of claim 5 further including means for obtaining a signal proportional to the voltage drop across a given cell, and means for preventing said comparator means from sending a signal to said motor control means when said cell voltage signal is below a preset value.

9. The apparatus of claim 5 further including means for obtaining a signal proportional to the voltage drop across a given cell, and means for preventing said comparator means from sending a signal to said motor control means when said voltage signal is above a preset value.

10. The apparatus of claim 5 further including means for preventing for a preset time period said compartor means from sending a signal to said motor control means upon sensing the switching of the rectifier on the system.

11. The apparatus of claim 5 wherein there are a plurality of anode sets within each cell, each anode set of each cell having its own motor control means and motor means so that said anode set may be raised or lowered with respect to the cathode separately from the other sets, each anode set having at least one anode bus associated therewith, said apparatus further including decoding means for determining which anode bus generated the high current signal and enabling actuation of the motor control means of the anode set with which the anode bus is associated.

12. An apparatus for generating signals from electrolytic cells of the liquid cathode type which are electrically connected in series, each cell having at least one anode and a plurality of anode buses connecting a given cell with the negative side of the preceeding cell, said apparatus including:

a. first and second spaced apart paired taps on each anode bus of each cell;
b. means for generating a pair of signals from each pair of taps;
c. a plurality of multiplexer means, each multiplexer means being associated with one of said cells, for continuously fast scanning said pairs of signals from all of the anode buses of said associated cell and having an output for the signal of each tap with the pair of signals from the pair of taps of any one anode bus being in sequence with the pair of signals from the other anode buses of said associated cell;
d. means for continuously converting the output from said multiplexer of said first and second tap signals to a signal proportional to current flow in each anode bus; and
e. means for continuously converting the output from said multiplexer of said first tap signals of a given cell with the output from said multiplexer of said first tap signals from the next succeeding cell to a signal proportional to voltage drop for the anode associated with the bus with which the signal from the tap originated.

13. The apparatus of claim 12 further including means for displaying said current proportional signal on an oscilloscope as a trace showing the signal for all buses of a given cell simultaneously.

14. The apparatus of claim 12 further including means for displaying said voltage drop proportional signal on an oscilloscope as a trace showing the signal for all buses of a given cell simultaneously.

15. The apparatus of claim 12 further including a third tap associated with each anode bus of a given cell and positioned on the cathode side of the preceeding cell adjacent to the connection of the anode bus leading to the given cell, means for generating a signal from said third tap, said signals from all the taps of a given cell being scanned sequentially by said multiplexer, and means for converting the output from said multiplexer of said first tap signals and said third tap signals into a signal proportional to voltage drop between the two taps.

16. A method of generating signals in a mercury cell circuit having a plurality of liquid cathode cells electrically connected in series, each of said cells having at least one anode and a plurality of anode buses, said method comprising:

a. generating a pair of signals from two spaced apart paired taps on each anode bus of each cell;
b. continuously fast scanning the pair of signals from each anode bus of a first one of said cells and continuously transmitting a first pair of signals including portions of the pair of signals from each bus of said first cell in sequence with each other bus of said first cell;
c. continuously fast scanning, simultaneously with said fast scanning of said first cell, the signals from each anode bus of a second one of said cells and continuously transmitting, simultaneously with said transmitting of said first pair of signals, a second pair of signals including portions of the pair of signals from each bus of said second cell in sequence with each other bus of said second cell; and
d. converting each of said pair of transmitted signals from said taps into a single signal proportional to the anode bus currents of the cell from which said converted scanned signals originated.

17. The method of claim 16 further including combining signals from all of the same taps of the anode buses of the next succeeding cell after said signals have been transmitted by scanning with the signals from the same taps on all the anode buses of a given cell after they have been transmitted by scanning to provide a voltage signal proportional to the voltage drop associated with the anode with which the anode buses are associated.

18. A method for adjusting the anode-cathode gap of a plurality of electrolytic cells of the liquid cathode type which are electrically connected in series, each cell including at least one anode, a plurality of anode buses connecting a given cell with the negative side of the preceeding cell, and motor control means for operating a motor for causing the anode to raise or lower with respect to said cathode, said method comprising:

a. means for generating a pair of signals from two spaced apart paired taps on each anode bus of each cell;
b. fast scanning a plurality of said cells simultaneously by sequentially selecting portions of the signals from each anode bus of each of said plurality of cells and transmitting a pair of multiplexed signals from each of said plurality of cells simultaneously, each of said pairs of multiplexed signals including sequential portions of the signals from the other buses of the associated cell from which said multiplexed pair of signals was transmitted.

c. converting each transmitted pair of multiplexed signals to a multiplexed converted signal proportional to current flow in each anode bus with sequential portions of each of said current flow proportional signals proportional to the current flow for each bus of the cell associated with said multiplexed converted signal, d. converting each of said current flow proportional signals to an average cell bus current signal; and e. simultaneously comparing the portions of said current proportional signal for each of said plurality of cells with said average cell bus current signal for that cell and sending an operating signal to the appropriate motor control means when said portion of said current proportional signal exceeds said average cell bus signal by a predetermined percentage to cause the motor means to raise the appropriate anode.

19. The method of claim 18 further including maintaining the motor control operative to cause the motor means to raise the anode for a minimum predetermined period of time after one signal pulse has been received by the motor control means.

20. The method of claim 18 further including preventing said operating signal from being sent to said motor control means when said average cell bus current signal is below a preset value.

21. The method of claim 18 further including obtaining a signal for each cell proportional to the voltage drop across the cell, and preventing said operating signal from being sent to said motor control means when said voltage drop proportional signal is below a preset value.

22. The method of claim 18 further including obtaining a signal for each cell proportional to the voltage drop across that cell, and preventing said operating signal from being sent to said motor control means when said voltage drop proportional signal is above a preset value.

23. The method of claim 18 further including preventing, for a predetermined time period, the operating signal for each cell from being sent to the motor control means upon sensing the switching of one or more rectifiers on the system.

24. The method of claim 18 wherein there are a plurality of anode sets within each cell, each anode set of each cell having its own motor control means and motor means so that said anode set may be raised or lowered with respect to the cathode separately from the other sets, each anode set having at least one anode bus associated therewith, said method further including electrically determining for a given cell which anode bus generated the operating signal and electrically enabling the operating signal to actuate said motor control means of the anode set with which the anode bus is associated.

* * * * *

UNITED STATES PATENT OFFICE

CERTIFICATE OF CORRECTION

Patent No. 4,082,639 Dated April 4, 1978

Inventor(s) Richard W. Ralston, Jr. and George K. Ames

It is certified that error appears in the above-identified patent and that said Letters Patent are hereby corrected as shown below:

Column 2, line 55, immediately after "than" insert --an overcurrent set point which is proportional to--.

Column 5, line 38, delete "fast" and insert --"fast"--.

Column 5, line 57, delete "differntial" and insert --differential--.

Column 9, line 7, delete "as" and insert --at--.

Column 13, line 39, delete "preceeding" and insert --preceding--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*